US005366295A

United States Patent [19]

Montesissa et al.

[11] Patent Number: 5,366,295

[45] Date of Patent: Nov. 22, 1994

[54] FLEXIBLE EASY-OPENING PACK

[75] Inventors: Giancarlo Montesissa, Robbio; Giovanni Prella, Vercelli, both of Italy

[73] Assignee: Nestec S.A., Vevey, Switzerland

[21] Appl. No.: 732,622

[22] Filed: Jul. 19, 1991

[30] Foreign Application Priority Data

Aug. 13, 1990 [EP] European Pat. Off. ..... 90115485.6

[51] Int. Cl.[5] ..... B65D 30/02; B65D 27/38

[52] U.S. Cl. ..... 383/201; 383/205

[58] Field of Search ..... 383/201, 205; 229/87.05

[56] References Cited

U.S. PATENT DOCUMENTS

| | | | |
|---|---|---|---|
| 2,699,285 | 1/1955 | Bell et al. | 383/205 X |
| 3,098,601 | 7/1963 | Anderson et al. | 383/205 |
| 3,175,752 | 3/1965 | Stabenow | 383/201 X |
| 3,187,982 | 6/1965 | Underwood et al. | 383/205 X |
| 3,266,713 | 8/1966 | Mårtensson et al. . | |
| 3,291,377 | 12/1966 | Eggen | 383/205 X |
| 3,295,739 | 1/1967 | Wilcox . | |
| 3,373,926 | 3/1968 | Voigtman, Sr. et al. . | |
| 3,396,900 | 8/1968 | Lucas | 383/205 |
| 3,403,840 | 10/1968 | Mathes | 383/201 X |
| 3,550,764 | 12/1970 | Tigner | 383/205 X |
| 3,552,631 | 1/1971 | Fuchs . | |
| 3,968,926 | 7/1976 | Smolderen et al. | 229/87.05 |
| 4,337,284 | 6/1982 | Cooper et al. | 383/205 |
| 4,638,911 | 1/1987 | Prohaska | 383/205 |
| 4,781,294 | 11/1988 | Croce | 383/201 X |
| 4,834,245 | 5/1989 | Ohga et al. | 383/201 |

FOREIGN PATENT DOCUMENTS 1264317 3/1968 Germany .

*Primary Examiner*—Allan N. Shoap
*Assistant Examiner*—Jes. F. Pascua
*Attorney, Agent, or Firm*—Vogt & O'Donnell

[57] ABSTRACT

A flexible liquid impermeable package is in the form of a tubular bag and has a tear-strip for opening the bag. The bag is made of monoaxially or biaxially stretched polyolefin film, and has opposed transverse welds and a longitudinal weld which is parallel to a stretched orientation of the film for sealing the bag. The tear strip is heat-welded to an outer surface of a wall of the bag, disposed away from and parallel to the longitudinal weld. The tear strip is made of polyolefin, and has a thickness greater than the thickness of the polyolefin film of the bag.

The invention relates to a flexible liquid-tight bag intended for a liquid food product or a food product containing a solid product immersed in a liquid, comprising a tear strip for easy opening of the bag with no spurting of liquid.

The tear strip is applied by heat sealing to the outer surface of the bag in the stretching direction of the constituent film of the bag.

9 Claims, 3 Drawing Sheets

FLEXIBLE EASY-OPENING PACK

BACKGROUND OF THE INVENTION

This invention relates to a pack of the flexible, easy-opening bag type, particularly for a liquid or liquid-containing food product.

Certain liquid or liquid-containing products, for example mozzarella, are sold in sealed flexible bags known as flow packs.

This type of pack has the advantage of being economical: it uses very little packaging material and enables the bags to be continuously filled during production. In addition, it is environment-friendly because the plastic packaging material, for example polyethylene, can be destroyed without emitting pollutants. The bags in question are also practical and compact and can be printed on their outer surface either with a message or with a trade mark.

Packs of the type in question have to be impervious, i.e. they have to withstand the pressure of the liquid and must not allow any losses of product, particularly in the interests of storage. This explains why they do not normally have an easy-opening system because conventional systems comprise pre-cuts or weakened lines in the actual wall of the bag which is not compatible with the need for imperviousness.

Finally, removal of the products from the packs for consumption involves the cutting or piercing of a sufficiently large opening, normally with a pair of scissors, to allow the liquid to flow out and the product to be subsequently removed. The liquid in the bag inevitably spills out during this operation and splashes the user.

In one known pack and process for packaging a product in a bag, the tear strip for easy opening is applied by heat sealing to the longitudinal edges of a tubular film and is used to seal the tube longitudinally. See, for example, U.S. Pat. No. 3,373,926. This system requires the application of a line of antisealing material at the ends of the tear strip to allow the formation of gripping tabs. A pack of this type is intended for the packaging of dry products of the snack type and is not suitable for the envelopment of liquid products where the bag has to be impervious and the sealing zones resistant.

To achieve impervious sealing, the tear strip would have to be wide and applied precisely along the longitudinal edges of the film. The longitudinal sealing zones along the strip would necessarily be narrow. The formation of an anti-sealing zone during the lateral sealing phase would require perfect adjustment and synchronization of the tools used for laterally sealing and cutting the bags and the lateral sealing zone would be narrow at this point. All these factors would multiply the risk of losses in the packaging of a liquid product applying pressure to the sealing zones during the filling and handling of the bags.

SUMMARY OF THE INVENTION

The object of the present invention is to solve the problem of continuously packaging a liquid or liquid-containing product in an easy-opening bag with no risk of leakage.

Accordingly, the invention relates to a pack of the flexible bag type formed by tubular envelopment using a monoaxially or biaxially stretched film comprising an outer tear strip for easy opening, more particularly for a liquid food product or for a food product containing a solid product immersed in a liquid.

DETAILED DESCRIPTION OF THE INVENTION

The pack according to the invention is characterized in that it is impervious to liquids and in that the tear strip is applied by heat-sealing to a part of the outer wall of the bag parallel to an orientation of the film.

In one preferred embodiment of the pack according to the invention, the tear strip is transversely pre-cut at one of its ends, for example over three quarters of its width, to create a gripping tab as will be explained hereinafter. The tear strip is preferably made of the same material as the film of the bag and is of greater thickness. It may be made of a laminated composite of which the layer in contact with the bag is made of the same material as the bag.

The constituent film of the bag is advantageously monoaxially stretched which gives it an orientation in one direction. Because the tear strip is parallel to the orientation of the film, the film can be torn along a straight line formed by the weld line between the film and the tear strip without any need for a weakening line to be formed in its thickness. The tear strip is preferably heat-sealed at a point close to a longitudinal edge of the bag.

The choice of the constituent material of the film is dictated by the requirements of the particular application envisaged.

Thus, the film may be made of a flexible, water-resistant and food-compatible plastic oriented by stretching, for example a polyolefin, such as low-density or medium-density polyethylene. The advantage of polyolefin films is that they can be heat-sealed without a heat sealing lacquer. These films may be surface-treated so that they can be printed.

The tear strip may be made, for example, of a polyester/polyethylene laminate composite, the polyethylene layer being in contact with the film of the bag so that the strip can be applied to the bag by heat sealing.

The invention also relates to a process for packaging a liquid food product or a food product containing a solid product immersed in a liquid, in which a monoaxially or biaxially stretched flexible film is continuously formed into a tube by longitudinal sealing, the tube is filled with product and transversely sealed and the bags are cut out.

The process according to the invention is characterized in that an outer tear strip is applied to the film before filling or to the tube during filling by heat sealing outside the longitudinal sealing zone and parallel to an orientation of the film.

The tear strip is preferably applied to only part of the length of a bag in order to form gripping tabs for starting the tear. A gripping tab is advantageously formed by that part of the strip which is not heat-sealed to the outer surface of the bag being precut over part of its width in the vicinity of its end near the transverse weld line of the bag and may readily be released by pulling to initiate opening of the bag.

An embodiment of the invention is shown in the accompanying drawings.

DETAILED DESCRIPTION OF THE DRAWINGS

Figure 1:
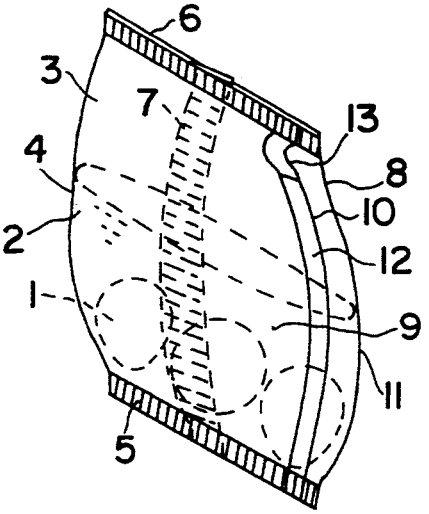
FIG. 1 illustrates a bag of mozzarella in the form of an envelope according to the invention.

Referring to FIG. 1, balls of mozzarella 1 and their preserving liquid 2 are accommodated in a flexible envelope 3 of monoaxially stretched low-density or medium-density polyethylene formed from a tube section 4. The tube section 4 is sealed by a lower transverse weld 5 and an upper transverse weld 6. A longitudinal weld 7 seals the tube 4 in the middle of the rear face 8 of the bag. A tear strip 10 is externally welded to the front face 9 of the bag in the vicinity of the longitudinal edge 11. The strip is made of low-density or medium-density polyethylene with twice the thickness of the envelope, pre-cut and welded to a part 12 of its length and leaves an unwelded part free to facilitate the release of a gripping tab 13 intended to start the tear. In FIG. 1, the strip is welded up to the weld 5. The weld line of the strip could of course stop in the vicinity of the lower end of the bag, providing a sufficiently large opening is created for easy removal of the balls of mozzarella.

Figure 2:
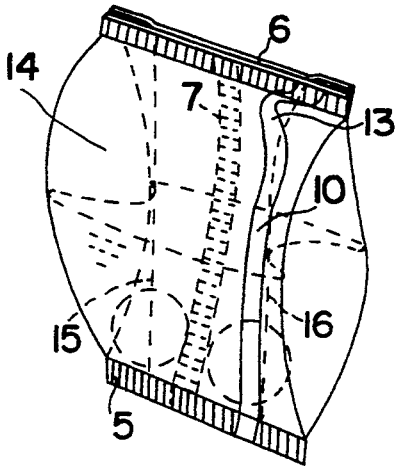
FIG. 2 illustrates a variant of the pack according to the invention relating to a gusseted bag.

In FIG. 2, the bag 14 has two longitudinal pleats 15,16 on each side to form a gusset. The only difference in relation to the envelope 3 is that the lateral welds include the folds and thus consist of four layers at their ends.

Figure 3:
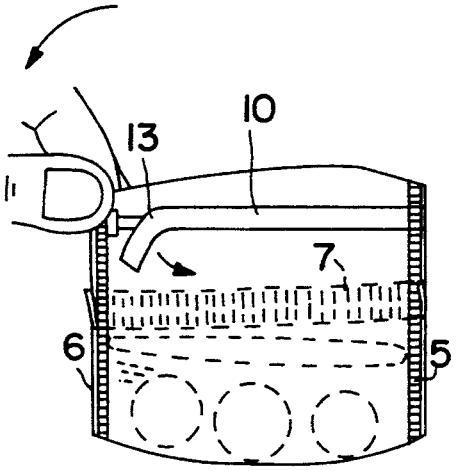
FIGS. 3 to 5 illustrate the various phases involved in the opening of the bag.
Figure 4:
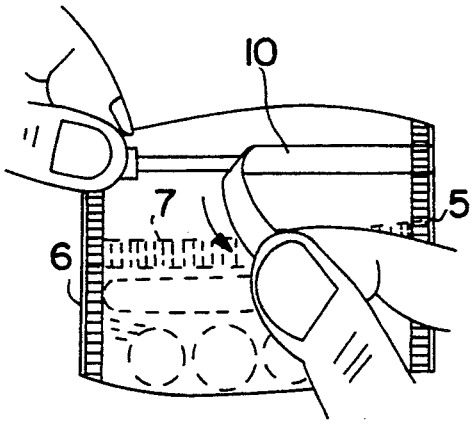
Figure 5:
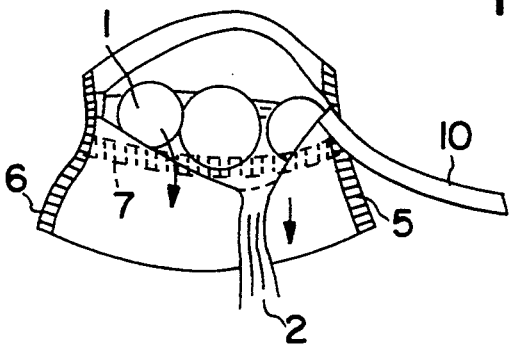

As shown in FIGS. 3, 4 and 5, the bag is opened by being turned through 90° and releasing the gripping tab 13 by tearing the pre-cut. The tear strip 10 is gripped by the tab 13 between the thumb and index finger and is pulled, for example, towards the right. The bag then tears cleanly along the weld line parallel to the upper longitudinal edge of the bag in the direction in which the film was stretched. The liquid may then be emptied and the product, for example the balls of mozzarella, may be removed through the slot thus formed without any spurting of liquid.

Figure 6:
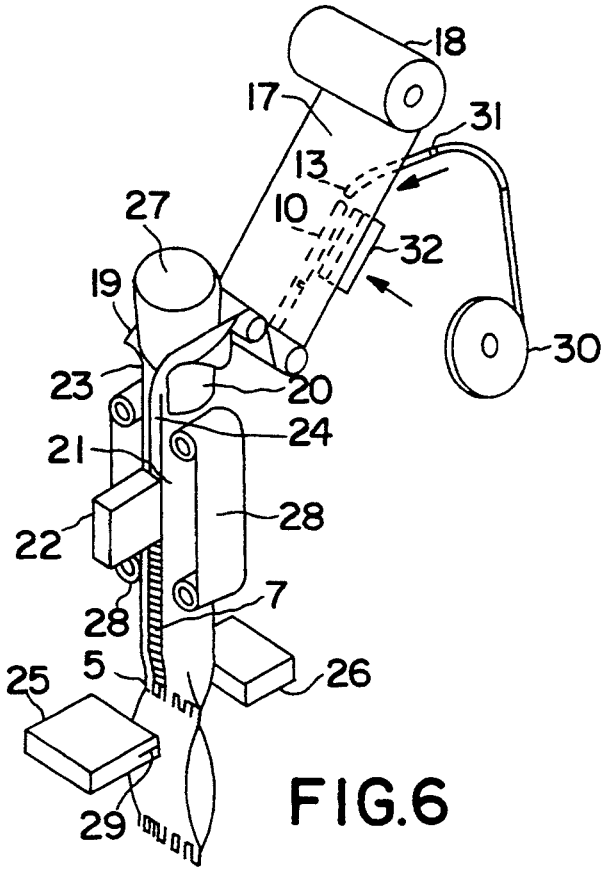
FIG. 6 diagrammatically illustrates one embodiment of the packaging process according to the invention.

In FIG. 6, the packaging film 17 coming from the roll 18 spreads out on the conveyor line by way of a shaper in the form of a so-called sailor's collar 19. The film 17 follows this collar which surrounds the top of a vertical metal tube 20. The collar causes the film to surround the tube. The tube 21 of film thus formed is sealed by a heated flat iron 22 which longitudinally presses the two superposed edges 23 and 24 of the film onto the counterpart of the tube. On leaving the tube, the tubular film 21 released from the tube is pinched between two transverse irons 25 and 26 which seal it transversely by welding. At the same time, the dosed product is delivered by gravity from the hopper 27 into the tube 20 and falls onto the lower transverse weld 5. The tube thus filled descends—with the width intended for the bag—under the control of a feed system 28 which draws the bag downwards to be welded by the two transverse irons 25 and 26. The width of the welding surface of the transverse irons may be separated by a cutting blade 29 which, at one and the same time, provides for closure of one bag, welding of the base of the following bag and the release of each individual bag from the machine.

Before the film is shaped into a tube, a spool 30 delivers the tear strip which is pre-cut at 31 and then sealed by a welding jaw 32 over only part of its length. That end of the strip which is not heat-sealed to the outer surface of the bag is included in the transverse welding of the bag beyond the cut so that a loop is formed. For opening, the gripping tab is easily released simply by pulling to break the bridge of material remaining over the width of the strip after the cut.

Figure 7:
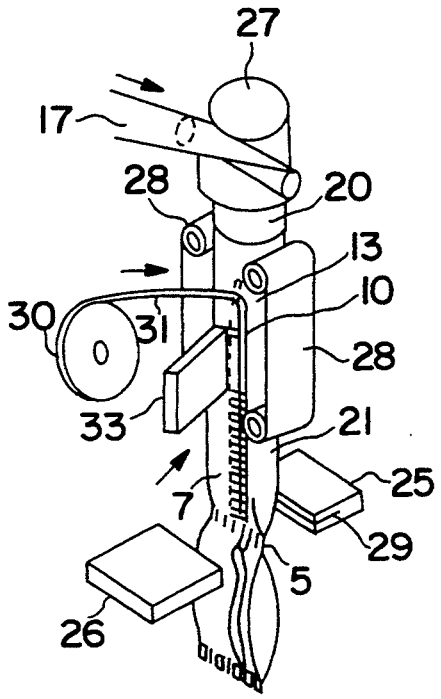
FIG. 7 diagrammatically illustrates a variant of the packaging process according to the invention.

In FIG. 7, the tear strip is unwound from the spool 30, pre-cut at 31 and applied by a welding iron 33 to the tube 21 already formed.

Figure 8:
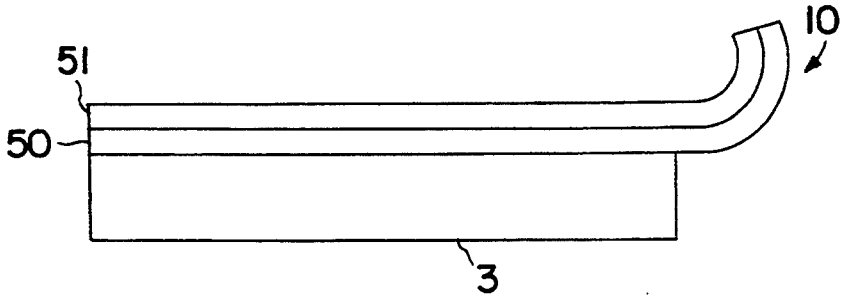
FIG. 8 illustrates a laminated composite tear strip in cross section.

The packaging process has been described with reference to the type of envelope shown in FIG. 1. The production of gusseted bags according to FIG. 2 is of course similar except that it requires tools to pleat the tubular film after its formation. FIG. 8 shows a tear strip 10 of a laminate composite of polyethylene 50 and polyester 51 heat sealed to a surface of bag 3.

We claim:

1. A flexible liquid impermeable package comprising:
   a tubular bag of liquid impermeable monoaxially or biaxially stretched polyolefin film, the tubular bag having opposed transverse welds and a longitudinal weld which is parallel to a stretched orientation of the polyolefin film for sealing the bag; and
   a tear strip heat-welded to an outer surface of a wall of the bag, disposed away from and parallel to the longitudinal weld, the tear strip being comprised of polyolefin and having a thickness greater than a thickness of the polyolefin film of the bag.

2. A package according to claim 1 wherein the tear strip is a laminated composite of polyester and polyolefin, and wherein a polyolefin surface of the composite is heat-welded to the outer wall of the polyolefin film bag.

3. A package according to claim 1 wherein the tear strip is heat-welded adjacent a longitudinal edge of the tubular bag.

4. A package according to claim 1 wherein the polyolefin film of the tubular bag is monoaxially stretched.

5. A package according to claim 1 wherein the polyolefin film of the tubular bag is biaxially stretched.

6. A package according to claim 1 wherein the tubular bag has longitudinal side pleats in the form of a gusset.

7. A package according to claim 1 or 2 wherein the tear strip is heat-welded to only a part of the outer surface of the bag, to provide an unwelded gripping tab for opening the bag.

8. A package according to claim 7 wherein the gripping tab is positioned adjacent to a transverse weld of the bag.

9. A package according to claim 1 wherein the tear strip is twice as thick as the film of the tubular bag.

* * * * *

UNITED STATES PATENT AND TRADEMARK OFFICE

CERTIFICATE OF CORRECTION

PATENT NO. : 5,366,295
DATED : November 22, 1994
INVENTOR(S) : Giancarlo MONTESISSA, et al.

It is certified that error appears in the above-indentified patent and that said Letters Patent is hereby corrected as shown below:

TITLE PAGE:

In the ABSTRACT, line 11, delete the following:

The invention relates to a flexible liquid-tight bag intended for a liquid food product or a food product containing a solid product immersed in a liquid, comprising a tear strip for easy opening of the bag with no spurting of liquid.

The tear strip is applied by heat sealing to the outer surface of the bag in the stretching direction of the constituent film of the bag.

Signed and Sealed this

Seventh Day of March, 1995

*Attest:*

Bruce Lehman

BRUCE LEHMAN

*Attesting Officer*

*Commissioner of Patents and Trademarks*